US005272511A

United States Patent [19]

Conrad et al.

[11] Patent Number: 5,272,511

[45] Date of Patent: Dec. 21, 1993

[54] SHEET INSERTER AND METHODS OF INSERTING SHEETS INTO A CONTINUOUS STREAM OF SHEETS

[75] Inventors: Charles E. Conrad, Scottsville; Robert A. Coons, Jr., Bloomfield; Thomas W. Cherry, Macedon, all of N.Y.

[73] Assignee: Xerox Corporation, Stamford, Conn.

[21] Appl. No.: 876,155

[22] Filed: Apr. 30, 1992

[51] Int. Cl.[5] ..... G03G 21/00

[52] U.S. Cl. ..... 355/325; 270/58; 270/59; 271/298; 355/316; 355/321

[58] Field of Search ..... 355/325, 324, 323, 321, 355/316, 25, 23; 270/58, 59, 45, 46, 51, 53; 271/298, 182, 258

[56] References Cited

U.S. PATENT DOCUMENTS

| | | | |
|---|---|---|---|
| 3,934,867 | 1/1976 | Oeschger, Jr. | 270/32 |
| 3,979,112 | 9/1976 | Munn et al. | 270/59 X |
| 4,248,525 | 2/1981 | Sterrett | 270/58 X |
| 4,273,319 | 6/1981 | Stocker | 270/58 X |
| 4,473,425 | 9/1984 | Baughman et al. | 270/58 X |
| 4,540,458 | 9/1985 | Baughman et al. | 270/58 X |
| 4,589,647 | 5/1986 | Roller | 271/94 |
| 4,595,187 | 6/1986 | Bober | 270/53 X |
| 4,602,776 | 7/1986 | York et al. | 271/4 |
| 4,626,156 | 12/1986 | Baughman et al. | 270/58 X |
| 4,727,402 | 2/1988 | Smith | 355/24 X |
| 4,757,348 | 7/1988 | Rourke et al. | 346/160 X |
| 4,763,161 | 8/1988 | Forest et al. | 355/325 X |
| 4,800,505 | 1/1989 | Axelrod et al. | 270/58 X |
| 4,800,506 | 1/1989 | Axelrod et al. | 270/58 X |
| 4,924,265 | 5/1990 | Partilla et al. | 355/325 X |
| 4,942,535 | 7/1990 | Francisco | 270/58 X |
| 4,961,092 | 10/1990 | Rabb et al. | 355/323 |
| 4,989,852 | 2/1991 | Gunther, Jr. | 270/58 X |
| 5,013,022 | 5/1991 | Graushar | 270/58 X |
| 5,080,340 | 1/1992 | Hacknauer et al. | 270/37 |
| 5,095,342 | 3/1992 | Farrell et al. | 355/319 |

FOREIGN PATENT DOCUMENTS

| | | | |
|---|---|---|---|
| 0427276 | 5/1991 | European Pat. Off. | 355/324 |

OTHER PUBLICATIONS

Morgan, P. F.; "Integration Of Black Only And Color Printers"; Xerox Disclosure Journal; vol. 16, No. 6, Nov./Dec. 1991; pp. 381-383.

*Primary Examiner*—A. T. Grimley
*Assistant Examiner*—Matthew S. Smith
*Attorney, Agent, or Firm*—Oliff & Berridge

[57] ABSTRACT

A sheet inserter inserts special insert sheets into a continuous stream of sheets by overlaying the insert sheets with a corresponding sheet in the continuous stream of sheets. The insert sheet overlaying the corresponding sheet in the continuous stream of sheets is then conveyed with the corresponding sheet to a final destination where the sheets can be compiled into a stack. The sheet inserter can be contained in a module which is removably attachable to a document finishing apparatus so as to insert the special insert sheets into the stream of sheets that are output from the document producing apparatus. When the document producing apparatus is associated with a finishing device such as a booklet maker, which compiles and stitches multiple copies of a booklet, the sheet inserter inserts one or more special insert sheets at the appropriate location(s) for each booklet as the sheets are entering the assembly station of the booklet maker. The special insert sheets can be cover sheets and/or center sheets for each booklet, and/or sheets to be inserted at other locations in each booklet.

22 Claims, 5 Drawing Sheets

SHEET INSERTER AND METHODS OF INSERTING SHEETS INTO A CONTINUOUS STREAM OF SHEETS

BACKGROUND OF THE INVENTION

1. Field of the Invention

The present invention relates to methods and apparatus for handling sheets, and in particular to methods and apparatus for inserting sheets into a stream of sheets prior to assembling the sheets into one or more documents.

2. Description of Related Art

With the general increase in quality, speed and capabilities of modern day copiers and printers (generally referred to as document producing apparatus), it has become increasingly desirable to place finishing devices (such as booklet makers) in-line with the document producing apparatus so that human intervention during the document producing process can be reduced. A best case scenario would require users to merely supply the document producing apparatus with blank sheets, initiate the document producing process, and then remove bound booklets from an output tray of the finishing device.

For example, when producing multiple copies of a document such as a booklet, the bypass sheet path of a high speed document producing apparatus such as the Xerox Docutech printer can be placed in communication with an inlet chute of a finishing device such as a booklet maker. The document producing apparatus would then be programmed to produce multiple copies of the document which would be output through the sheet bypass as a continuous stream of sheets. The continuous stream of sheets would contain multiple collated sets of the document. As the sheets enter the booklet maker, the sheets from each set are compiled at an assembly station until one complete copy is contained in the assembly station. When one complete copy of the booklet is contained in the assembly station, the sheets of the booklet are aligned (e.g., by jogging and/or tamping), the booklet is bound (for example, by stapling) and then ejected from the assembly station.

The end-of-set signal which is conventionally output by the document producing apparatus is used by the booklet maker to identify the last sheet of each copy of the booklet so as to initiate the staple/eject cycle.

When the speed at which sheets are output by the document producing apparatus and the speed at which the booklet maker performs its function (e.g., align, bind and eject) are appropriate, it is not necessary to insert skipped pitches between each collated set of the document in the continuous stream of sheets output by the document producing apparatus. That is, as long as the booklet maker can align, staple and eject the booklet before the first sheet of the next copy of the booklet reaches the assembly station of the booklet maker, the document producing apparatus can operate at full speed.

One example involves the use of the above referenced Docutech apparatus in combination with a Signature Booklet Maker (SBM). As is well known in the art, a signature is a sheet having two page images formed on each side thereof. For a more detailed description of signature production, see U.S. Pat. No. 4,727,402 to Smith et al, the disclosure of which is incorporated herein by reference. The signature booklet maker usually includes three modules: the first module compiles the signatures for one booklet into a stack in an assembly station, aligns the compiled signatures, staples the stack along a central binding portion thereof, and then ejects the bound stack into the second module; the second module folds the stapled stack into a booklet; and the third module trims the uneven edge of the folded booklet. Since signature printing is two sided printing (duplex printing), typically on large 11×17 inch sheets, the time between each sheet output by Docutech is sufficient for the first module of the SBM (also known as the stitcher) to align, staple and eject a booklet before the first sheet of the next booklet reaches the stitcher. When printing signatures on smaller sheets, where the time between each sheet is less, it may be necessary to insert a skipped pitch between the last sheet of a set and the first sheet of an immediately subsequent set in order to allow the stitcher to perform its functions prior to receipt of the first sheet of the subsequent set. The need for skipped pitches depend on the speed of the document producing apparatus and the speed of the finishing apparatus, and thus is not limited to the above-described example.

Even when using state of the art document producing and finishing apparatus, it may be necessary to insert sheets into the document which are produced by means other than the document producing apparatus, or produced at a separate time from the majority of the sheets contained in the document. For example, it is not uncommon to place specially colored sheet, chapter dividers, photographs or other special sheets into a document. It is generally not desirable or possible to produce these special sheets in the document producing apparatus.

For example, it is common to use preprinted sheets which were produced by four-color offset press techniques as special insert sheets in a document containing mostly text printed on ordinary white paper. In booklets produced from signatures, these special sheets are often used as cover sheets or center sheets containing, for example, coupons. It is not desirable to pass these sheets through the document producing apparatus because the ink on the special sheets tends to be smudged by the paper-handling rollers, etc. of the document producing apparatus.

Accordingly, these special sheets must be inserted into the stream of sheets produced by the document producing apparatus. It is desirable to insert these sheets without disrupting the flow of the continuous stream of sheets. It is also desirable to insert these sheets in a manner which is transparent to the document producing and finishing apparatus so that the operation of these apparatus need not be modified.

U.S. Pat. No. 5,080,340 to Hacknauer et al. discloses a modular finisher apparatus for use with a reproduction apparatus, for forming completely finished reproductions. The finisher apparatus includes a receiver for receiving sheets of sets from the reproduction apparatus. A first feed path extends from the receiver to a sheet collector where received sheets are directed. Collected sheets are stapled into finished reproduction sets. A second feed path extends from the sheet collector to a set collector where finished reproduction sets are collected. The finisher also includes at least one of the following devices: a Z-folder, a saddle stitcher, and an insert tray. Sheet transport paths are provided to any of the included devices.

U.S. Pat. No. 4,602,776 to York et al., assigned to Xerox Corporation, discloses an insertion apparatus for use with a copier and/or a collator for providing on-line and off-line insertion of sheet material or collation, respectively. A supply tray is loaded with one or more types of insert material, each type being separated by a first type of coded sheet. A copying operation is interrupted when a second type of coded sheet, located in the stack to be copied and indicating a location where insert sheets are to be inserted, is detected. As the insert sheets are fed, a second sensor detects the first type of coded sheet (indicating the end of the group of insert sheets), which is then fed to an overflow tray. The normal copying operation is then resumed.

U.S. Pat. No. 4,248,525 to Sterrett discloses an apparatus for producing sets of collated copies wherein some of the sheets in a document (regular sheets) can be reproduced in a collating mode by means of a copier having a recirculating document handler (RDH), while other sheets in the document (insert sheets) cannot be produced in a collating mode by the RDH. Each sheet which cannot be imaged using the RDH is first individually copied multiple times and fed to a separate storage bin. These sheets later will be inserted into the stream of collated regular sheets as they are copied and output from the copier. A controller is preprogrammed with the page numbers of the sheets to be inserted. The regular sized sheets are then placed (in order) in the RDH, and multiple collated copies are made and fed toward a finisher (stapler). Copies of the regular sized sheets in the document are thus output from the copier in order (collated), with the insert sheets missing. Since the controller keeps track of the number of sheets being copied, the controller is able to temporarily stop the RDH at the appropriate time and cause the appropriate insert sheet to be fed from its corresponding storage bin into the stream of regular sheets output from the copier. Thus, collated complete copies of a document are formed.

U.S. Pat. No. 4,961,092 to Rabb et al., assigned to Xerox Corporation, discloses a pre-programmed post-collation system for a copier which uses plural sorter bins and a recirculating document handler. Preprogrammable pause points in the copying operation allow for insertion of a variable number of job inserts or other special copy sheets into the bins being filled (by producing copies of these special documents or by manually inserting them into the bins), repeatably, at any selected document copying point. The copying sequence must be manually restarted after the appropriate insertion operation is completed.

OBJECTS AND SUMMARY OF THE INVENTION

It is an object of the present invention to provide methods and apparatus for inserting sheets into a continuous stream of sheets without disrupting or inserting skipped pitches into the continuous stream of sheets.

It is another object of the present invention to provide a method and apparatus for inserting cover sheets and/or center sheets of a booklet into a continuous stream of sheets output by a document producing apparatus to a finishing apparatus without modifying the operation of the document producing or finishing apparatus.

To achieve the foregoing and other objects, and to overcome the shortcomings discussed above, a sheet inserter inserts special insert sheets into a continuous stream of sheets by overlaying the insert sheets with a corresponding sheet in the continuous stream of sheets. The insert sheet overlaying the corresponding sheet in the continuous stream of sheets is then conveyed with the corresponding sheet to a final destination where the sheets can be compiled into a stack.

In a preferred embodiment, the sheet inserter is contained in a module which is removably attachable to a finishing device so as to insert the special insert sheets into the stream of sheets that are output from the document producing apparatus. When the document producing apparatus is associated with a finishing device such as a booklet maker, which compiles and binds multiple copies of a booklet, the sheet inserter inserts one or more special insert sheets at the appropriate location(s) for each booklet as the sheets are entering the assembly station of the booklet maker. When, for example, the special insert sheets are cover sheets, and the document producing apparatus outputs a continuous stream of sheets containing multiple collated sets of the document in reverse (N−1) order (wherein page one of the document is the last sheet of each set produced by the document producing apparatus), the end-of-set signal conventionally output by the document producing apparatus, and used by the booklet maker to initiate a booklet binding cycle, is transparently used by the sheet inserter to insert the cover sheet into the continuous stream of sheets output by the document producing apparatus by overlaying the cover sheet with page one of the document.

Insert sheets such as center sheets which must be inserted into the assembly station of the finishing device prior to the first sheet of each set can also be inserted by the sheet inserter of the present invention. Center sheet insertion can be initiated by waiting a predetermined time period after the output of the end-of-set signal, so that the center sheet is inserted into the assembly station of the finishing device after a bound booklet is ejected therefrom. As a bound booklet is ejected from the assembly station, the insert (center) sheet is forwarded to the assembly station before the first sheet of the next set in the continuous stream of sheets.

Both cover sheets and center sheets can be inserted for each booklet by providing multiple collated sets of cover sheets and center sheets in an insert tray of the sheet inserter.

Sheets other than cover or center sheets (i.e., sheets other than first or last sheets of each set) can also be inserted as long as the document producing apparatus can output a signal indicative of the desire to insert an insert sheet on top of a corresponding sheet in the continuous stream of sheets output by the document producing apparatus. This insert-signal can be provided, for example, by producing each sheet in the continuous stream of sheets upon which an insert sheet is to be overlayed with machine readable indicia thereon. An optical reader can then be provided in the document producing apparatus for detecting the machine readable indicia, and for providing a signal which can be used by the sheet inserter to initiate an insert cycle.

In the preferred embodiment, wherein the sheet inserter is provided as a detachable module for use with different types of image producing apparatus and finishing apparatus, the insert sheet tray of the sheet inserter may be located a considerable distance from the output of the document producing apparatus. Accordingly, the sheet inserter can include a prefeed station to which a next insert sheet to be inserted into the continuous stream of sheets is fed after being withdrawn from the insert sheet tray. The prefeed station is located closely adjacent to the sheet path containing the continuous stream of sheets output from the document producing apparatus. The withdrawn insert sheet is stopped and held in the prefeed station until the signal indicative of the desire to insert a sheet into the continuous stream of sheets is provided. In this way, the insert sheet can be immediately inserted into the continuous stream of sheets so as to overlay the appropriate corresponding sheet in the continuous stream of sheets. As the insert sheet is conveyed from the prefeed station, the next insert sheet in the insert sheet tray is withdrawn therefrom and conveyed to the prefeed station where it is maintained until the next insert signal is provided.

BRIEF DESCRIPTION OF THE DRAWINGS

The invention will be described in detail with reference to the following drawings in which like reference numerals refer to like elements, and wherein.

DETAILED DESCRIPTION OF THE PREFERRED EMBODIMENTS

A preferred embodiment of the present invention will now be described in connection with the associated drawings. In this preferred embodiment, a sheet inserter is provided as a module which can be separated from the apparatus which prints sheets, and which performs finishing operations on the document. The present invention is equally applicable to sheet inserters which are provided within document producing apparatus, such as, for example, copiers having separate insert sheet receiving trays. These copiers when modified according to the present invention would insert sheets from the insert sheet tray by overlaying the inserted sheet with a sheet contained in a continuous stream of sheets produced by the copier. Accordingly, the described embodiment is intended to be illustrative, not limiting.

Figure 1:
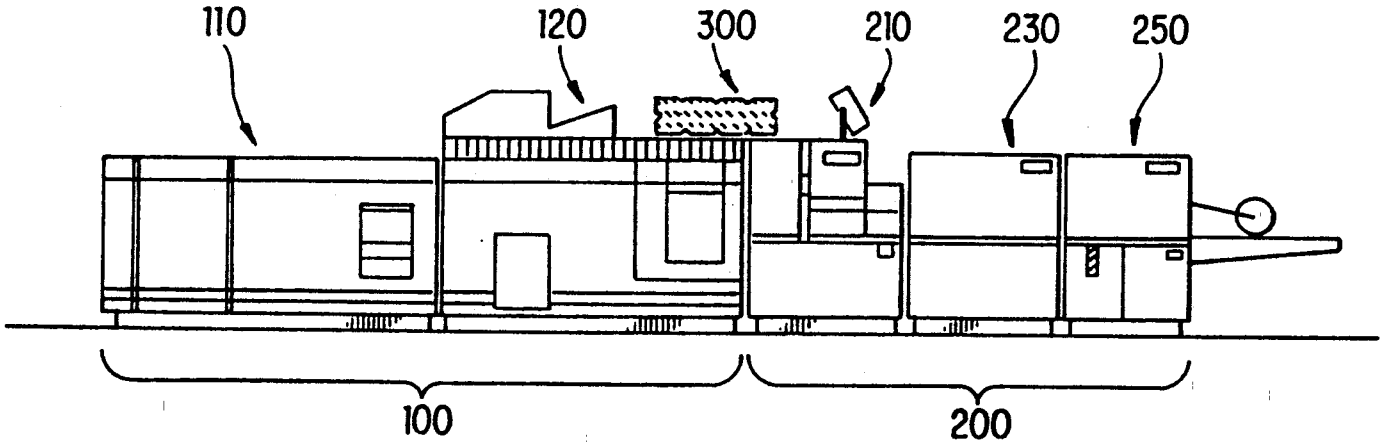
FIG. 1 is a side view of a document producing system including a document producing apparatus, a finishing device, and a sheet inserter according to one embodiment of the present invention.

FIG. 1 illustrates a document producing system capable of outputting completed signature booklets. The system includes a document producing apparatus 100 which can be, for example, the Xerox Docutech Printing System, a signature booklet maker 200 and a sheet inserter 300 constructed and operated in accordance with the present invention. The Docutech Printing System 100 and the signature booklet maker 200 are well known and thus will be briefly described.

The Xerox Docutech Printing System 100 generally includes an imaging device 110 which is a laser printing system, and a finisher 120 which can be used to form booklets by binding a plurality of sheets to one another along a side edge thereof. This differs from the function performed by SBM 200 in that SBM 200 binds a plurality of sheets to one another along a central portion of each sheet. Accordingly, when used to form signature booklets, as will be described below, the continuous stream of sheets produced by image device 110 passes through finisher 120 via a finisher sheet bypass 124 (see FIG. 2). Thus, when used to form signature booklets, finisher 120 is only used to hold a supply of plain paper sheets which are imaged by printing device 110, and to provide a path through which printed sheets are fed from imaging device 110 to SBM 200. For a more detailed description of the Xerox Docutech Printing System see, for example, U.S. Pat. No. 5,095,342 to Michael Farrell et al., the disclosure of which is incorporated herein by reference. (The finisher sheet bypass is not illustrated in U.S. Pat. No. 5,095,342, but is readily incorporated therein as is well known in the art.)

SBM 200 is one example of a finishing device which can be used with a printing system. A signature is a duplex printed copy sheet having two page images on each side. A signature sheet can be folded in half to form a booklet, or a plurality of signatures can be aligned, stitched together and folded in half to form a multi-sheet booklet. A description of signature printing is provided in the above-incorporated U.S. Pat. No. 4,727,042 to Smith et al. The signatures are usually stapled along their fold line.

SBM 200 is comprised of three modules, a saddle stitcher 210, a folder 230, and a trimmer 250. The printer 100 exports sheet arrival times and end-of-set signals to the SBM equipment so that SBM 200 can operate on-line with image producing apparatus 100. The first module 210 receives and aligns the copy sheets in a set (which set forms a single booklet) so that all sheets in the set are aligned with one another. The first module aligns each sheet by stopping the forward movement of the sheet (e.g., with a gate or sheet stop), and then laterally tapping each sheet against another sheet stop. Once all sheets in the set are received and are aligned, the first module stitches (or binds) the sheets of a set of each other at a central location (between each page image on a sheet). The stitching operation can comprise, for example, stapling. Thus, the first module 210 is referred to as a "saddle stitcher". An example of a saddle stitcher for off-line use is illustrated in U.S. Pat. No. 4,595,187 to Bober, the disclosure of which is incorporated herein by reference.

The stitched copy set is then forwarded to a second module 230 which folds the stitched copy set in half about the stitch axis. Thus, the second module 230 is referred to as a "folder".

The folded copy set is then forwarded to a third module 250 where the edges of the sheets opposite from the fold are trimmed. Thus, the third module 250 is referred to as a "trimmer". Trimming is necessary, particularly in large sets or booklets, because the edges of the sheets opposite the fold become uneven due to the folding operation.

Conventionally, SBM 200, and in particular, saddle stitcher 210, performs the align/stitch/eject operation for each copy set based upon the end-of-set signal produced by document producing apparatus 100 with the last sheet in each set. As discussed earlier, saddle stitcher 210 can be designed so as to perform the align/-stitch/eject operation on a booklet before the first sheet of the next copy set reaches the assembly station of saddle stitcher 210. However, prior to the present invention, when a special type of cover sheet, such as, for example, a preprinted cover sheet which was produced by a four-color off-set press technique was to be included in each booklet, the printing and flow of sheets from printing device 110 had to be temporarily stopped so that a user could manually insert the cover sheet into the assembly station of stitcher 210. Alternatively, if a sheet feeder was provided, a skipped pitch (empty space which would normally contain a printed sheet) was provided in the stream of sheets produced by printing device 110 so that the cover sheet could be inserted into the skipped pitch and fed into the assembly station of saddle stitcher 210.

According to the present invention, an insert sheet feeder 300 is provided and controlled so as to insert cover sheets (or other special insert sheets—to be described in more detail below) into the continuous stream of sheets produced by imaging device 110 without disrupting the production or flow of sheets from imaging device 110. In other words, with sheet inserter 300 of the present invention, no skipped pitches are required and no stoppage in the output of sheets by imaging device 110 need occur.

Figure 2:
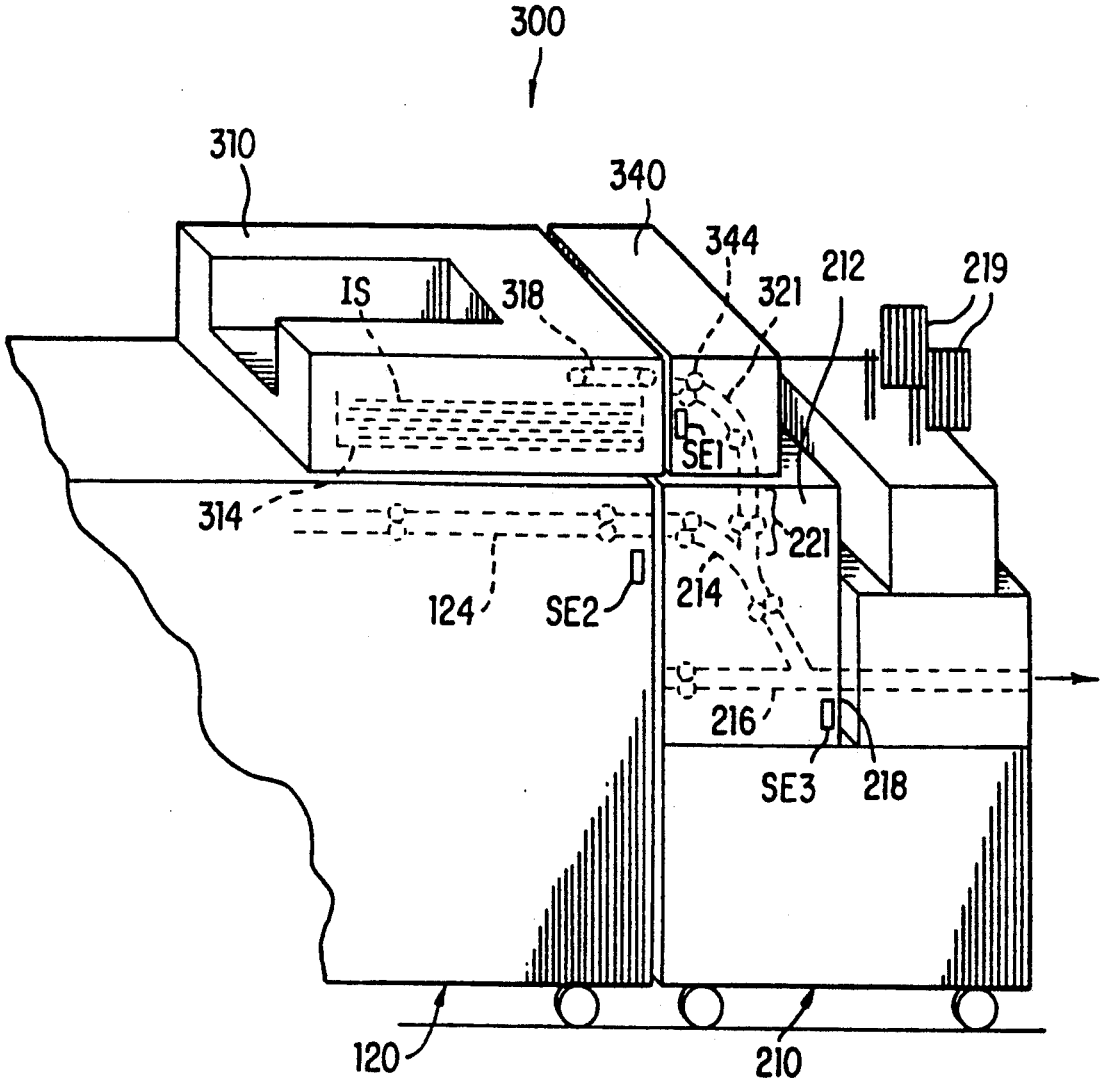
FIG. 2 is a perspective schematic view of a sheet inserter according to the present invention, and illustrates the basic components thereof as attached to a document producing apparatus and an input station of a document finishing apparatus.

Referring to FIG. 2, sheet inserter 300 is illustrated in conjunction with the downstream end of finisher 120 of image producing apparatus 100, and with the input station 212 of saddle stitcher 210 of SBM 200. Conventionally, the continuous stream of sheets produced by imaging device 110 is output through finisher sheet by-pass 124. and received through first input chute 214 of SBM input station 212. A second input chute 216 is conventionally provided in SBM input station 212 for use with image producing apparatus other than Docutech. The continuous stream of sheets exit via the outlet 218 of SBM input station 212 and are then compiled in an assembly station (not shown) of saddle stitcher 210. Wire spools 219 used for stapling central portions of the signatures contained in the continuous steam of copying sheets are illustrated in FIG. 2. A sheet stream sensor SE2 is provided adjacent to the output of finisher sheet bypass 124, and is used to confirm the output of sheets from image producing apparatus 100. Thus, sheet stream sensor SE2 functions as a jam detector. Additionally, when the end-of-set signal is produced by imaging device 110, sheet stream sensor SE2 confirms the location and output of the last sheet of a set from bypass 124. After receiving the end-of-set signal from image producing apparatus 100, SBM 200 uses trail edge sensor SE3 to detect the trailing edge of the last sheet of a copy set. After detecting the trailing edge of the last sheet of a copy set with detector SE3, saddle stitcher 210 waits a predetermined time period (based upon the speed of the continuous stream of sheets and the distance between sensor SE3 and the assembly station of saddle stitcher 210) before performing the align/staple/eject cycle.

In accordance with the present invention, an insert sheet receiving chute 221 is added to SBM input station 212. Chute 221 receives insert sheets from sheet inserter 300.

Sheet inserter 300 includes an insert feeder 310 and a Feeder/SBM interface transport 340.

Insert feeder 310 can correspond to the Xerox 1065 VCF overhead vacuum corrugated feeder. Insert feeder 310 includes an insert sheet tray 314 which can hold a plurality of insert sheets IS, and a corrugated vacuum belt 318 and associated hardware. For an example of a corrugated vacuum feeder, see U.S. Pat. No. 4,589,647 to Roller, the disclosure of which is incorporated herein by reference.

After insert sheets are withdrawn from insert feeder 310, the insert sheets are conveyed through insert sheet feed path 321 of Feeder/SBM interface transport 340. Feed rollers 344 are provided in insert sheet path 321 for conveying the insert sheets therethrough. An insert sheet sensor SE1 is provided between corrugated vacuum belt 318 and feed rollers 344. Although insert feeder 310 and interface transport 340 are illustrated in FIG. 2 as two separate items, it is understood that they can be formed integrally.

Because there is a considerable distance between insert sheet tray 314 and first chute 214 in SBM input station 221, according to a preferred embodiment of the present invention, the uppermost sheet in insert sheet tray 314 is withdrawn from tray 314 by corrugated vacuum belt 318 and partially conveyed through insert sheet path 321 by feed rollers 344 so that its leading edge is located just upstream of the point where insert sheet receiving chute 221 and first chute 214 merge. Accordingly, shortly after the leading edge of the corresponding sheet (in the continuous stream of sheets) is detected by sheet stream sensor SE2 (i.e., shortly after the leading edge of the sheet exits image producing apparatus 100), feed rollers 344 are re-activated to convey the prefed insert sheet entirely out of insert sheet path 321 and through insert sheet receiving chute 221 so as to overlay the corresponding sheet in the continuous stream of sheets output through sheet bypass 124.

As used herein, "overlay" refers to at least partially covering one sheet with an insert sheet. The insert sheet need not be perfectly registered with the corresponding sheet in the continuous stream of sheets, but can overlap the corresponding sheet so that the insert sheet and corresponding sheet are offset. The degree of offset can be up to 6–7", but is preferably no more than 3–4". When the copy sets output by imaging device 110 are produced in reverse order (N−1 order) so that page one of the document is the last sheet in the set (and thus, the sheet to which the end-of-set signal is associated), and cover sheets are being inserted from sheet inserter 300, the overlaid sheets will correspond to the last two sheets to be inserted into the assembly station of saddle stitcher 210 (i.e., page one of the document and the cover sheet). The integrity of the operation performed by saddle stitcher 210 is not adversely affected by the overlaid sheets because the align/stitch/eject cycle is not initiated until the trailing edge of the last sheet is detected by sensor SE3. If detection of the leading edge of the last sheet were used to initiate the align/stitch/eject cycle of saddle stitcher 210, then the overlaid sheets would need to be more precisely registered. More precise registration can be readily accomplished with appropriate software controls; however, such increased control is not required with the present invention. Additionally, in order to simplify control of the overall system, sheet inserter 300 feeds insert sheets at the same speed which document producing apparatus 100 feeds the continuous stream of sheets. If insert sheet feeder 300 were operated at a higher speed, it would not be necessary to prefeed sheets.

Figure 3:
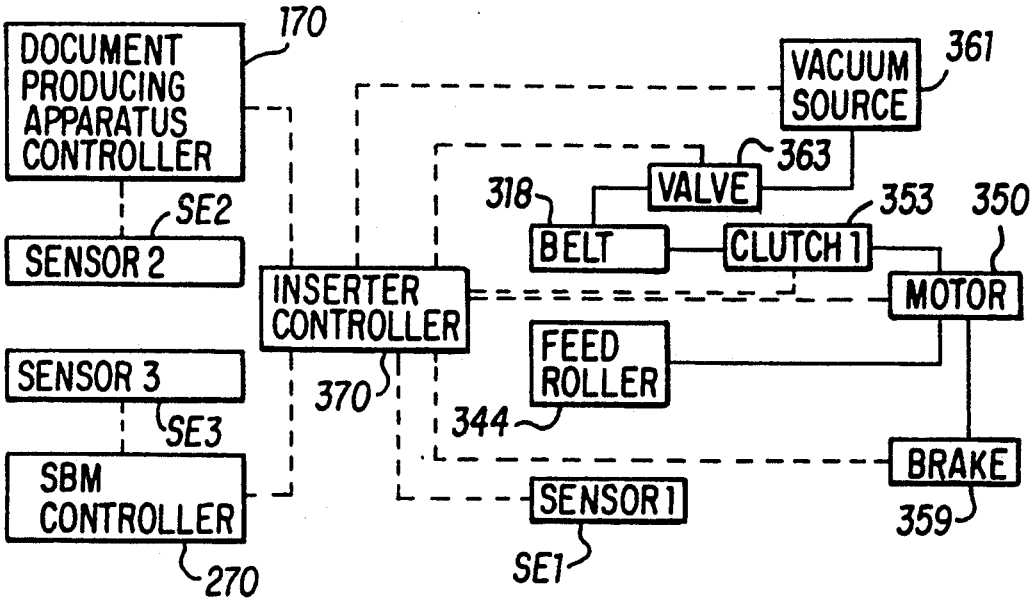
FIG. 3 is a block diagram of the hardware components of the sheet inserter of FIG. 2.

FIG. 3 is a block diagram illustrating the hardware components of sheet inserter 300 and the interrelationship with the components of image producing apparatus 100 and SBM 200. Corrugated vacuum belt 318 is selectively rotated by motor 350, which is linked to belt 318 via a clutch 353. Motor 350 is directly connected to feed roller 344. Alternatively, separate motors could be provided for belt 318 and feed roller 344. An electromagnetic brake 359 is provided to assist in stopping motor 350, to more accurately locate insert sheets withdrawn from insert sheet tray 314 within the prefeed station of insert sheet path 321. An inserter controller 370 which can be, for example, a microcomputer, controls vacuum source 361, valve 363, motor 350, clutch 353, electromagnetic brake 359, and receives input from insert sheet sensor SE1.

Inserter controller 370 also receives signals from the document producing apparatus controller 170 and from the SBM controller 270. Because controller 370 is capable of controlling sheet inserter 300 so that insert sheets are overlaid with sheets in the continuous stream of sheets output by imaging device 100, sheet inserter 300 operates in a manner which is transparent to document producing apparatus 100 and SBM 200.

Figure 4:
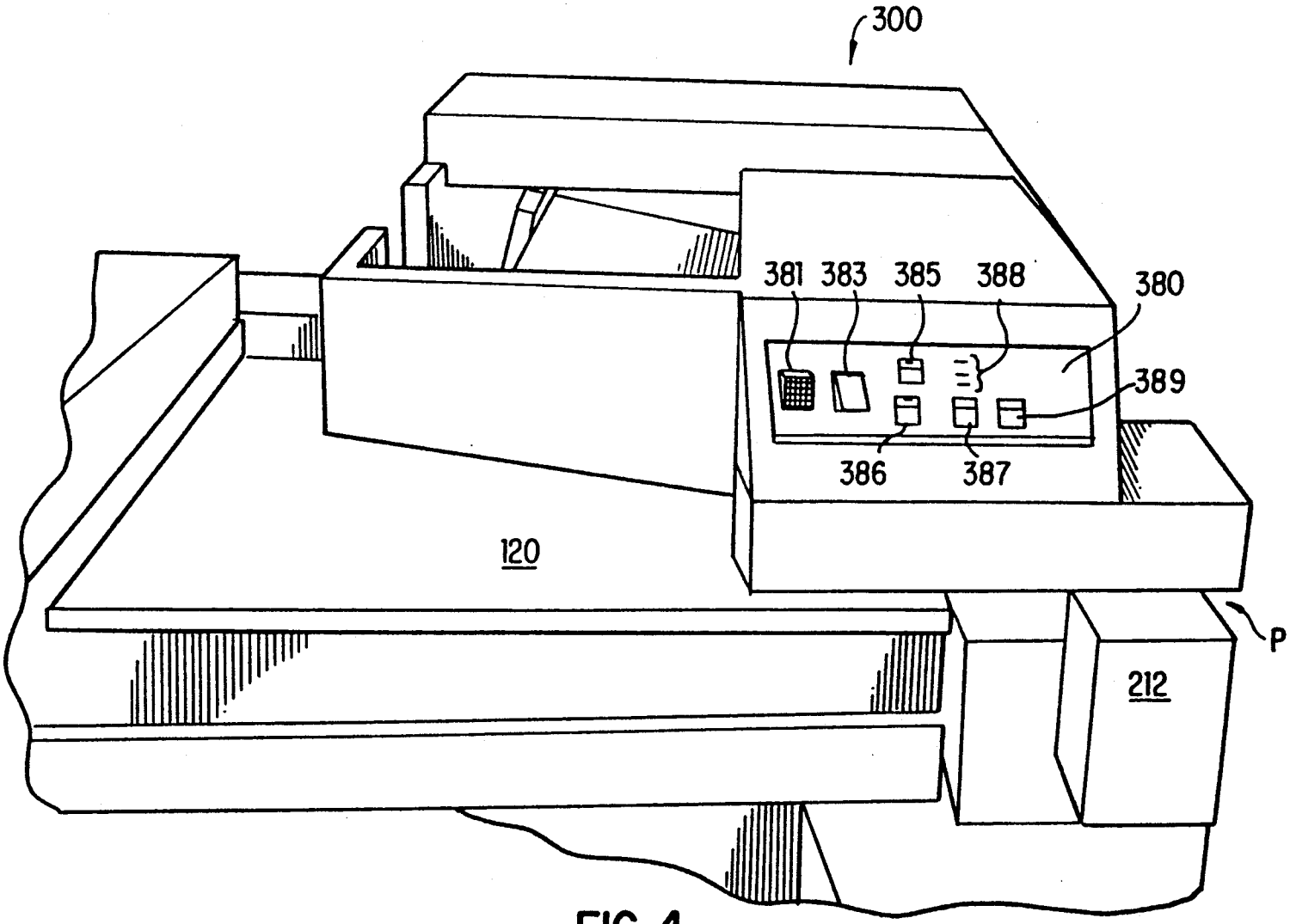
FIG. 4 is a perspective view of an outer housing of a sheet inserter, and illustrates the user interface provided thereon.

FIG. 4 is a perspective view of sheet inserter 300, illustrating the outer housing enclosing insert feeder 310 and interface transport 340. Additionally, the user interface (UI) 380 is shown. Sheet inserter 300 can be pivotally attached to input station 212 of SBM 200 as indicated by arrow P. A hinge similar to that used for pivotally holding recirculating document handlers on copiers can be used.

User interface 380 of sheet inserter 300 includes a power switch 381, a fault light 383, start button 385, stop button 386, mode selection switch 387, mode indicator lights 388, and a load paper switch 389. The use of the switches will be described below in connection with operation of sheet inserter 300.

Sheet inserter 300 operates to insert sheets from insert tray 314 into the stream of sheets output from image producing apparatus 100 by overlaying the appropriate sheet in the continuous stream of sheets with an insert sheet supplied from tray 314. The insertion operation is initiated by a signal indicative of the desire to insert an insert sheet from insert tray 314 into the sheet stream. Controller 370 is appropriately programmed to initiate a sheet insertion procedure in response to any of a number of signals provided externally of sheet inserter 300. For example, when the sheet to be inserted will be the last sheet in a stack of sheets to be compiled by saddle stitcher 210, the end-of-set signal naturally produced by image producing apparatus 100 is used by sheet inserter 300 to indicate the desire to insert an insert sheet from insert tray 314. When the sheet to be inserted will be the first sheet of a stack of sheets to be compiled in the assembly station of saddle stitcher 210, the end-of-set signal is still used to indicate the desire to insert an insert sheet from insert tray 314. However, a predetermined time period is allowed to pass before the sheet at the prefeed station is inserted into the stream of continuous sheets. This predetermined time period is sufficient to permit the previous booklet in the assembly station of the signature booklet maker to be stitched and ejected therefrom before the inserted first sheet of the next set reaches the assembly station. In the case of inserting a first sheet of a stack, this sheet would not overlay any sheets in the continuous stream of sheets. However, this aspect of the present invention is useful in that it enables in an insert sheet to be inserted without providing a skipped pitch.

Additionally, even when skipped pitches are required in the continuous stream of sheets to permit the saddle stitcher 210 to perform its operation, the ability of sheet inserter 300 to operate independently and transparently (i.e., based upon the naturally occurring end-of-set signal) permits the first sheet of a stack of sheets to be inserted without modifying the operation of document producing apparatus 100 or SBM 200.

As a third alternative, sheets can be inserted and overlaid with corresponding sheets in the continuous stream of sheets output by image producing apparatus 100 based upon signals other than the end-of-set signal. For example, image producing apparatus 100 could be programmed to output a sheet insert signal in conjunction with appropriate sheets in the continuous stream of sheets upon which an insert sheet is desired to be oversaid. Alternatively, sheets upon which an insert sheet is to be overlaid could be produced by imaging device 110 so as to have machine readable indicia (such as, for example, a bar code) thereon, and an optical reader can be provided in, for example, the bypass 124 of finisher 120 for detecting the bar code, and for outputting a signal to controller 370 indicative of the desire to insert an insert sheet upon the marked sheet.

Additionally, in order to insert a first sheet and a last sheet from sheet inserter 300 for each copy set of a document, collated insert sets containing these two types of different insert sheets can be provided in insert tray 314. Each type of insert sheet would then be respectively inserted before and after each copy set of the document into the continuous stream of sheets output by image producing apparatus 100. In this situation, the end-of-set signal would be used by sheet inserter 300 for initiating each sheet insertion, with there being a delay between insertion of the cover sheet (last sheet) of one set and the center sheet (first sheet) of the subsequent set.

Figure 5:
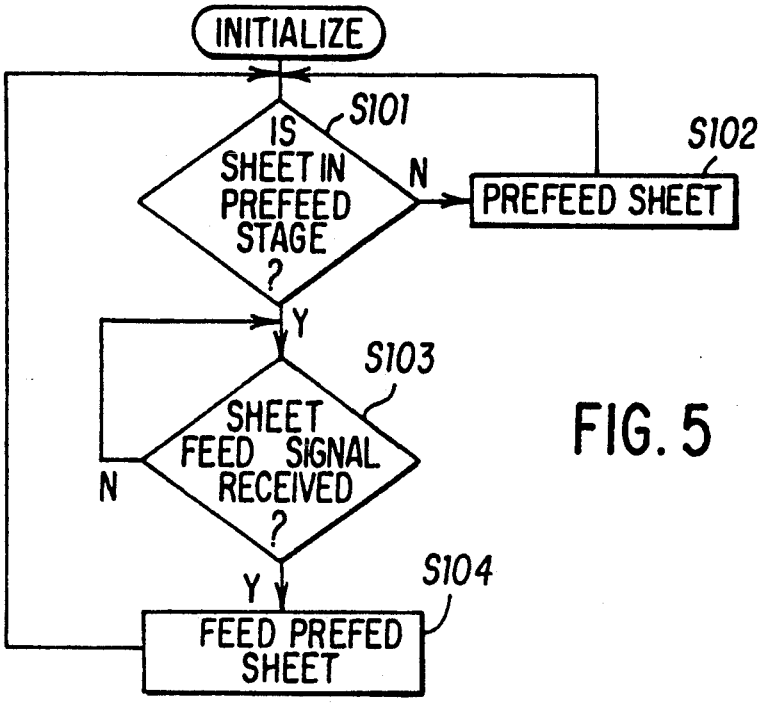
FIG. 5 is a high level flowchart of a sheet feeding procedure performed by the sheet inserter of the present invention.

With reference to FIG. 5, the higher lever processes preformed by sheet inserter 300 will now be described. Upon actuation of power switch 381, sheet inserter 300 performs conventional initialization procedures. At this time, an operator can lower insert sheet tray 314 by pressing load paper switch 389. After lowering tray 314, the insert sheets IS (which in the described example will be cover sheets for insertion into a continuous stream of sheets output in reverse (N−1) order by image producing apparatus 100) are placed in tray 314. Upon actuation of load paper switch 389, insert sheet tray 314 is raised until the top of the stack of sheets contained therein is properly located adjacent to corrugated vacuum feed belt 318. The operator then presses mode selection switch 387 until the light indicating COVERS is lighted.

In the described example, three possible modes can be selected: COVERS for inserting cover sheets, C-SERTS for inserting center sheets, and MANUAL for off-line operation which will be described below. Once an appropriate mode is selected, the user then presses start button 385. Once start button 385 is pressed, flow proceeds to step S101 where a determination is made whether an insert sheet is located in the prefeed stage of sheet inserter 300. In the present example, when sheets are located in prefeed stage, a portion of the withdrawn insert sheet is located in insert sheet path 321 with a trailing edge of the withdrawn insert sheet remaining over insert sheet tray 314. Accordingly, insert sheet sensor S1 is used to determine whether a sheet is located in the prefeed stage. If a sheet is not detected in the prefeed stage, flow proceeds to step S102 where a sheet is prefed into insert sheet path 321. If a sheet is located in the prefeed stage, flow proceeds to step S103. In step S103, a determination is made as to whether a sheet feed signal has been received. Once a sheet feed signal is received, flow proceeds to step S104 where the insert sheet is fed from insert sheet path 321 into the continuous stream of sheets. Flow then turns to step S101.

In the present example, where cover sheets are inserted, the inserted cover sheet is fed from the prefeed stage so as to overlay at least a portion of the last sheet of the document output from image producing apertures 100. 450 milliseconds after beginning to feed the prefed sheet, insert sheet sensor SE1 is checked to insure that the prefed sheet has moved from the prefeed location. It is has, the uppermost sheet in insert sheet tray 314 is withdrawn from tray 314 and conveyed partially through insert sheet path 321. This procedure repeats itself until the requisite number of copies of the document are produced. When sheet inserter 300 is switched off by actuation of stop button 386, the prefed sheet located in insert sheet path 321 is fed into the assembly station of saddle stitcher 210. This cover sheet can be removed from the assembly station of saddle stitcher 210 by the user and returned to insert sheet tray 314 for future use.

Figure 6:
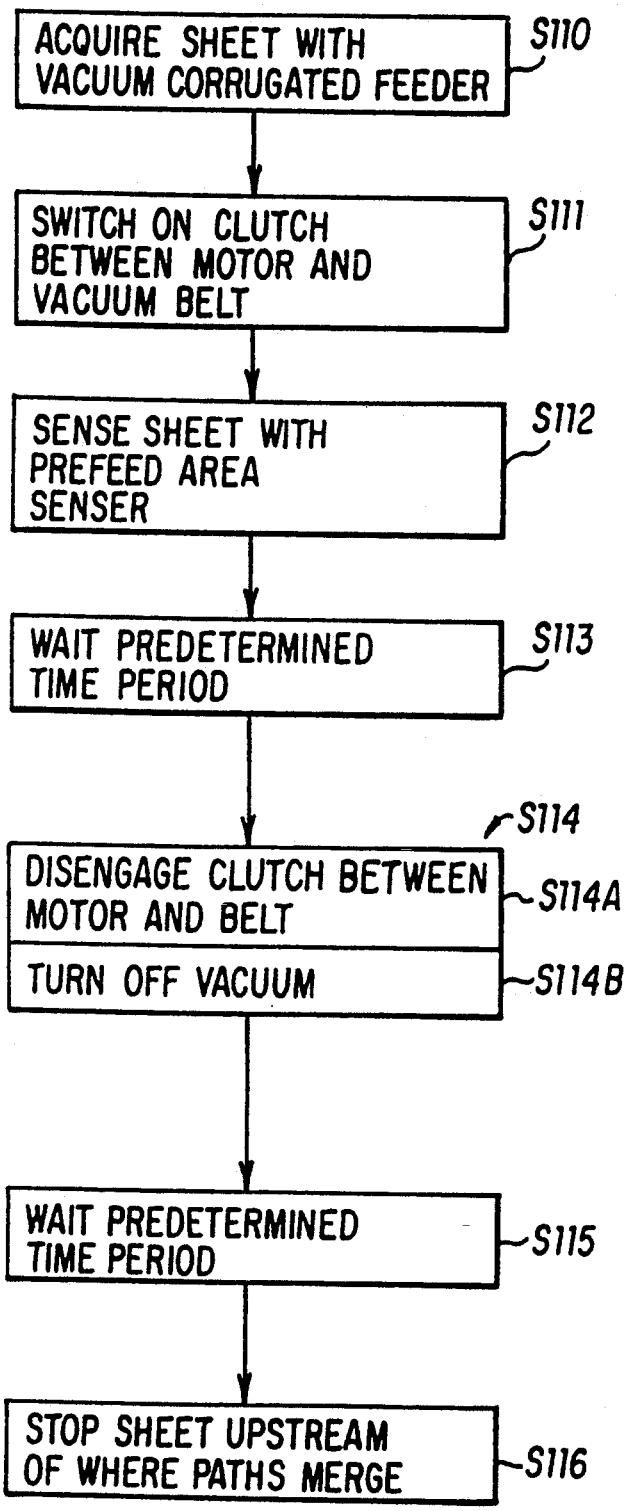
FIG. 6 is an intermediate level flowchart illustrating a sheet feeding operation performed by the sheet inserter of the present invention.

FIG. 6 illustrates the specific steps which are performed in order to prefeed insert sheets from insert sheet tray 314 of the preferred embodiment of the present invention illustrated in FIGS. 2 and 3.

When the controller has moved the previous prefed sheet into the stitcher, the controller 370 determines that a sheet is no longer at sensor SE1. Then, the uppermost sheet in tray 314 is acquired in S110 using the vacuum corrugated feeder. This involves actuating vacuum source 361 (which can be, for example, a blower) while maintaining solenoid valve 363 activated so that the vacuum provided by source 361 is applied through apertures in belt 318. This causes the upper few sheets in tray 314 to be acquired by belt 318. Due to the corrugations in belt 318, all but the uppermost sheet drop back into the stack of sheets in tray 314. Next, in step S111, motor 350 is actuated, and the belt clutch 353 is controlled to link motor 350 to the rollers around which belt 318 is wound. This causes the uppermost sheet in the stack to be withdrawn from tray 314. Once the withdrawn sheet is sensed by insert sheet sensor SE1 in step S112, controller 370 waits a predetermined time period in S113 appropriate for conveying the withdrawn insert sheet between feed rollers 344.

Once the withdrawn insert sheet is located between feed rollers 344, controller 370 deactivates corrugated vacuum belt 318 in step S114. Transport motor 350 remains activated so as to convey the withdrawn sheet partially through insert sheet path 321. Specifically, in order to deactivate corrugated vacuum feed belt 318, the feed belt clutch 353 between motor 350 and belt 318 is disengaged in step S114A, and the vacuum supplied to belt 318 is switched off in step S114B. The feed belt clutch 353 is disengaged in a conventional manner in order to prevent the next sheet in tray 314 to be fed. Usually, with top feeding corrugated vacuum belt systems, the vacuum from source 361 is continuously applied. However, because the cover sheets frequently contain ink deposited by off-set printing techniques, which can be easily smudged as the insert sheet is withdrawn from tray 314 by feed rollers 344, the present inventors have discovered that it is useful to switch off the vacuum supplied to belt 318. The vacuum is quickly shut off by providing a solenoid valve 363 between vacuum source 361 and belt 318. When solenoid valve 363 is deactuated, the vacuum passage between source 361 and belt 318 is inhibited. This prevents the ink containing surface of cover sheets from dragging along belt 318, thus preventing smudging of the image contained on the insert sheets. Conventional top feeding currugated vacuum feeders usually are used with plain paper, and thus have not addressed this smudging problem.

After the sheet is sensed by insert sheet sensor SE1, controller 370 waits a predetermined time period in step S115 and then stops the withdrawn insert sheet so that its leading edge is located just upstream of the merger between first input chute 214 and insert sheet receiving chute 221 in step S116. The predetermined time period used in step S115 depends on the speed at which sheets are fed by feed rollers 344, the length of insert sheet path 321 and chute 221, and the speed at which motor 350 can be stopped. It is possible to stop the insert sheet by dynamically braking motor 350. This involves reversing the polarity of the signal supplied to motor 350 so that motor 350 comes to a stop. Motor 350 is stopped before it begins rotating in the opposite direction. In order to more precisely control the position of the sheet when stopped, it is preferable to include an electromagnetic brake 359 to also stop motor 350.

Once the appropriate sheet insert signal is detected by controller 370, motor 350 is reactivated so as to rotate feed rollers 344 to insert the withdrawn insert sheet from the prefeed stage into the assembly station of saddle stitcher 210. At this point, the prefed procedure is repeated.

As described earlier, when the C-SERT mode is selected with mode selection switch 387, sheet inserter 300 delays a predetermined time period after the end-of-set signal in order to insert prefed sheets into the assembly station of saddle stitcher 210. The predetermined time period is appropriate for the stack of sheets in the assembly station of stitcher 210 to be aligned, bound and ejected before the prefed insert sheet reaches the assembly station.

The disclosed architecture also lends itself to feeding precollated sets of sheets to the booklet maker in an off-line MANUAL mode. This stand alone mode is selected by mode selection switch 387 while sheet feeder 300 is off-line. At this time, sheet feeder 300 goes into a LEARN mode. The operator then loads one booklet of the stack of booklets to be compiled into tray 314, and raises tray 314 by pressing load paper switch 389. When the tray is at the proper height for feeding, and upon pushing the start button, feed motor 350 is turned on and feeds the sheets that were loaded until tray 314 is empty, while controller 370 is conjunction with sensor SE1 counts the number of sheets fed. Sheet inserter 300 then goes into an EXECUTE mode. The operator then lowers tray 314, fills it with a stack of reverse collated books and raises tray 314. Again, when the tray is at the proper height, and the start button is pushed, the feed mechanism starts feeding sheets. When the sheet count reaches coincidence with the number obtained from the LEARN mode, sheet inserter 300 generates an end-of-set signal to SBM 200 to initiate the align/stitch/eject cycle.

This cycle repeats itself until insert sheet tray 314 is empty. When the tray is empty, the operator has the option of refilling the tray and continuing, or pressing the mode button 387 to cancel stand alone operation.

As discussed above, any signal can be used to indicate the desire to insert a sheet into the continuous stream of sheets output by image producing apparatus 100. For example, bar codes can be used to actuate sheet inserter 300. For a more detailed description of the use of bar codes for actuating sheet feeder trays, see related U.S. patent application Ser. No. 07/796,524, filed Nov. 22, 1991 to Robert A. Coons et al. For an example of a printing system capable of printing sheets with bar codes see U.S. Pat. No. 4,757,348 to Rourke et al, the disclosure of which is incorporated herein by reference.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method of inserting insert sheets from an insert tray into a stream of sheets without disrupting a flow of the stream of sheets, comprising:

a) prefeeding an insert sheet from said insert tray to a prefeed station prior to insertion of the sheet into said stream of sheets, said insert sheet coming to a stop in said prefeed station prior to being inserted into the stream of sheets;

b) receiving a signal indicative of the desire to insert the insert sheet from said prefeed station into said sheet stream; and c) inserting the insert sheet from said prefeed station into said sheet stream based on said signal so that the insert sheet overlays one of the sheets in said sheet stream and is transported simultaneously with said one sheet in said sheet stream.

2. The method of claim 1, wherein said insert sheet overlaps said one sheet.

3. The method of claim 1, wherein said stream of sheets are output by an imaging device, and said signal indicative of the desire to insert an insert sheet from said insert tray is output by said imaging device in conjunction with a sheet in said sheet stream upon which the insert sheet is to be overlayed.

4. The method of claim 1, wherein said stream of sheets is collated.

5. The method of claim 4, wherein said collated stream of sheets comprises multiple duplicate sets of sheets consecutively produced by an imaging device.

6. The method of claim 5, wherein said insert sheets include at least cover sheets for said multiple sets, said multiple sets are produced in reverse order, and said signal indicative of the desire to insert an insert sheet from said insert tray is an end-of-set signal output by said imaging device with the production of a last sheet in each set.

7. The method of claim 6, further comprising:

feeding said sheet stream containing said overlayed cover sheets to a finishing device which compiles all sheets in each set into a stack at an assembly station, and then ejects each stack from said assembly station.

8. The method of claim 7, further comprising:

inserting a second type of insert sheet, different from said cover sheets, from said insert tray into said sheet stream a predetermined time period after the output of said end-of-set signal, so that said second type of insert sheet reaches said assembly station prior to a first sheet of a next set in said sheet stream, said insert tray containing multiple collated sets of insert sheets, each collated set comprising one of said cover sheets and one of said second type of insert sheets.

9. The method of claim 8, wherein said finisher is a saddle stitcher, and said second type of insert sheet is a center sheet.

10. The method of claim 5, wherein said sheets in said sheet stream are signatures.

11. The method of claim 1, further comprising:

feeding said sheet stream containing said overlayed insert sheets to a finishing device.

12. The method of claim 11, wherein said finishing device is a saddle stitcher.

13. In a document production system wherein a continuous stream of sheets are fed to a destination, a sheet inserter comprising:

an insert sheet tray;

means for feeding insert sheets from said insert sheet tray into said continuous stream of sheets, and including a prefeed station located between said insert sheet tray and the continuous stream of sheets; and means for controlling said means for feeding so that each insert sheet is fed from said insert sheet tray and temporarily stopped in said prefeed station prior to being inserted into said continuous stream of sheets, and so that each inserted insert sheet overlays one of the sheets in said continuous stream of sheets and is transported simultaneously with said one sheet in said continuous stream of sheets to the destination.

14. The sheet inserter of claim 13, wherein said means for controlling controls said means for feeding insert sheets so that each inserted insert sheet overlaps said one sheet in said continuous stream.

15. The sheet inserter of claim 13, wherein said means for controlling includes means for detecting a signal indicative of the desire to insert an insert sheet from said insert tray into said continuous stream of sheets, and controls said means for feeding based on said signal.

16. The sheet inserter of claim 13, wherein the signal indicative of the desire to insert a sheet is an end-of-set signal produced by the document production system upon the production of a last sheet in a set of a document, multiple collated sets of which are consecutively produced by the document production system.

17. A sheet inserter for removable attachment to an output of a document producing apparatus which outputs a continuous stream of sheets, said sheet inserter comprising:

an insert sheet tray;

an insert sheet path extending from said insert sheet tray to an insert sheet outlet of said sheet inserter, said insert sheet outlet being positionable adjacent to the output of the document producing apparatus so that insert sheets can be inserted into the continuous stream of sheets through said insert sheet path;

means for feeding insert sheets from said insert sheet tray to said insert sheet outlet and including:

means for individually withdrawing insert sheets from said insert sheet tray and moving the withdrawn insert sheet into said insert sheet path; and means for conveying said withdrawn insert sheets through said insert sheet path and out of said insert sheet outlet; and means for controlling said means for feeding to feed insert sheets into the continuous stream of sheets so that an inserted insert sheet is overlayed with a desired sheet in said continuous stream of sheets, said means for controlling causing said means for conveying to temporarily stop the withdrawn insert sheet in said insert sheet path until said means for controlling determines that the withdrawn insert sheet is to be inserted onto the desired sheet in said continuous stream of sheets.

18. The sheet inserter of claim 17, further comprising an insert sheet path detector for detecting whether an insert sheet is located in a portion of said insert sheet path, a withdrawn insert sheet being located in said portion when said conveying means is temporarily stopping the withdrawn insert sheet in said insert sheet path, and wherein said means for controlling causes said means for withdrawing to withdraw a sheet from said insert sheet tray when said insert sheet path detector does not detect an insert sheet in said portion of said insert sheet path.

19. The sheet inserter of claim 17, wherein said means for withdrawing is a corrugated vacuum feed belt sheet feeder located above said insert sheet tray, and said conveying means is at least one roller pair located in said insert sheet path and driven by a motor.

20. The sheet inserter of claim 17, wherein said means for controlling includes means for receiving signals from the document producing apparatus, and controls said means for feeding based on said signals.

21. The sheet inserter of claim 20, wherein some of the signals received by said means for receiving signals are end-of-set signals produced by the document producing apparatus upon the production of a last sheet in a set of a document, multiple collated sets of which are consecutively produced by the document producing apparatus, and said means for controlling controls said means for feeding to insert an insert sheet into the continuous stream of sheets based on said end-of-set signals.

22. A sheet inserter for removable attachment to an output of a document producing apparatus which outputs a continuous stream of sheets, said sheet inserter comprising:

a housing;

an insert sheet tray located in said housing;

an insert sheet path located in said housing and extending from said insert sheet tray to an insert sheet outlet of said sheet inserter, said insert sheet outlet being positionable adjacent to the output of the document producing apparatus so that insert sheets can be inserted into the continuous stream of sheets through said insert sheet path;

means for pivotally attaching said housing to the document producing apparatus so that said insert sheet outlet communicates with the output of the document producing apparatus;

means, located in said housing, for feeding insert sheets from said insert sheet tray to said insert sheet outlet; and means, located in said housing, for controlling said means for feeding to feed insert sheets into the continuous stream of sheets so that an inserted insert sheet is overlayed with a desired sheet in said continuous stream of sheets.

* * * * *